United States Patent [19]

Pierorazio

[11] Patent Number: 4,927,118

[45] Date of Patent: May 22, 1990

[54] BEACH ACCESSORY DEVICE

[76] Inventor: Donato A. Pierorazio, 124 Riverside Rd., Baltimore, Md. 21221

[21] Appl. No.: 229,324

[22] Filed: Aug. 8, 1988

[51] Int. Cl.[5] ..... F16M 13/00

[52] U.S. Cl. ..... 248/545; 5/417; 135/118; 206/515; 220/339; 220/375; 248/156; 248/499

[58] Field of Search ..... 248/508, 499, 545, 156; 135/118, 119; 141/331, 339; 206/515; 220/375, 339, 380; 5/417, 418, 419, 420

[56] References Cited

U.S. PATENT DOCUMENTS

| | | | |
|---|---|---|---|
| 1,773,760 | 8/1930 | Steinbreder | 135/118 |
| 2,623,633 | 12/1952 | Bladow | 248/156 X |
| 2,647,718 | 8/1953 | Diseea | 135/118 X |
| 2,682,904 | 7/1954 | Divine | 248/156 X |
| 2,840,092 | 6/1958 | Hill | 135/118 |
| 2,899,153 | 8/1959 | Parker | 248/508 X |
| 2,907,057 | 10/1959 | Specht | 5/417 |
| 2,939,468 | 6/1960 | Boyce | 135/118 X |
| 3,226,737 | 1/1966 | Rote | 5/417 |
| 3,593,909 | 7/1971 | Bergmann | 220/375 X |
| 4,454,824 | 6/1984 | Wood | 248/156 X |
| 4,468,823 | 9/1984 | Tounjian | 5/417 |
| 4,546,507 | 10/1985 | Weinstein | 5/417 X |
| 4,654,906 | 4/1987 | Roberts | 5/417 |
| 4,699,165 | 10/1987 | Barizana | 135/118 |
| 4,773,559 | 9/1988 | Sasaki et al. | 220/375 X |

FOREIGN PATENT DOCUMENTS

| | | | |
|---|---|---|---|
| 994741 | 10/1976 | Canada | 248/DIG. 10 |
| 1015922 | 8/1977 | Canada | 248/508 |
| 1074888 | 4/1954 | France | 248/156 |
| 279132 | 3/1952 | Switzerland | 248/156 |

*Primary Examiner*—David L. Talbott
*Attorney, Agent, or Firm*—Leonard Bloom

[57] ABSTRACT

A device for retaining a beach towel or the like in place, especially on the sand of a beach. The device includes a receptacle having an open portion for receiving sand or the like therein. The sand applies a substantially downward force thereon, thereby weighing the device down and retaining it in place. A stem depending portion of the device extends downwardly from the receptacle and is received in the sand further retaining the device in place. A lid removably engages the receptacle over the open portion thereof with, preferably, a "snap-action", thereby retaining hte sand therein. Means is provided for removably securing the towel to the device, thereby retaining the towel in place. In one embodiment, this means is provided by the removable engagement between the lid and the receptacle, such that when a portion of the beach towel is disposed therebetween, this engagement concomitantly engages that portion of the towel retaining the towel in place. In a second embodiment, this means is provided by an aperture formed in the lid for receiving the towel therethrough, and a resilient spring clip that is carried by the lid within the receptacle which grips and retains the towel in place. Another embodiment is a beach accessory for receiving small articles. The lid is further designed for receiving beverage containers.

30 Claims, 5 Drawing Sheets

BEACH ACCESSORY DEVICE

FIELD OF THE INVENTION

The present invention relates to devices for anchoring, maintaining, and retaining a blanket, beach towel or the like on the sand of a beach and, in particular to a beach accessory device for anchoring and retaining a beach towel. It also relates to a device for receiving small articles at the beach.

BACKGROUND OF THE INVENTION

The anchoring retaining and maintenance of beach towels, blankets and the like on the sand on the beach has long proven to be extremely troublesome. This problem is particularly encountered where, as is often the case, a strong breeze or wind is present. Whatever the particular reason, the combination of activity, sand and surf often results in the movement and/or distortion of the placement of the towel or blanket on the sand.

There have been numerous devices proposed for anchoring and maintaining beach blankets and towels o the sand of a beach. Those devices of which I am aware, are as follows:

| U.S. Pat. No. | Inventor | Year of Issue |
|---|---|---|
| 2,190,566 | Julian | 1940 |
| 2,647,718 | Disera | 1953 |
| 2,840,092 | Hill | 1958 |
| 2,889,129 | Turbeville | 1959 |
| 3,237,904 | Abruzese | 1966 |
| 3,241,202 | Knauft | 1966 |
| 3,456,660 | Borchardt | 1969 |
| 4,699,165 | Barzana | 1987. |

In each of the above devices, the blanket or towel is secured thereto by suitable means such as a "spring clip" (KNAUFT), a resiliently-biased pen (HILL), a ring clip (BARZANA) or some other conventional clip (DISERA) or by use of a face plate which "snaps" over a staff, securing a towel therebetween (ABRUZESE).

However, in each of the above-cited arrangements, the device disclosed has a portion thereof which extends downwardly for piercing the sand in order to permit it to be disposed therein. In doing so, sand only contacts the device about the outer periphery thereof. Thus, the only force holding and retaining the device in place is a substantially sideward peripheral force of the sand about the device.

Therefore, while being equipped to provide adequate sideward support, the devices disclosed in each of the references are, nonetheless, readily susceptible to substantially upward forces exerted thereon. Such upward forces, if not counteracted, can pull the device upwardly out of the sand resulting in dislodgement of the device and deformation of the towel or the like.

Accordingly, it can be seen that there remains a need for a device for anchoring and maintaining a beach towel, or the like, in the sand of, for example, a beach, in which the sand is received therein exerting a substantially downward force, in addition to the substantially sideward force, thereon, thereby holding the device in place.

Furthermore, at the beach, there is frequently a need for an accessory for placement of small articles such as keys and coins. This accessory is particularly needed when persons wish to enter the water and might otherwise lose these valuables. Additionally, an accessory to keep beverage containers and other items in an upright position above the level of the sand is highly desirable.

SUMMARY OF THE INVENTION

It is a primary object of the present invention to provide a device for anchoring and retaining a beach towel or the like, in the sand of, for example, a beach, which has a portion thereof which receives sand thereon whereby substantially downward force is substantially received thereon.

It is still a further object of the present invention to provide a device for use at the beach for placement of small articles such as keys and coins, the device being anchored and retained in the sand.

An additional object of the present invention is to provide a device which can be anchored and retained in the sand of, for example, at a beach, to keep beverage containers and other items in an upright position above the level of the sand.

In accordance with the teachings of the present invention, there is disclosed a device for retaining a beach towel or the like in place. This device includes a receptacle for receiving sand or the like therein on a portion thereof. In this manner, a substantially downward force is applied thereon, thereby weighing the device down and retaining the device in place. The receptacle has an open portion formed therein through which the sand may pass for filling and emptying the receptacle. The receptacle further has a portion thereof that is received in sand or the like. Lastly, a lid is provided for engaging the receptacle about the open portion thereof, whereby the lid is removably retained on the receptacle. In this manner, when a portion of the beach towel or the like is disposed between the lid and the receptacle, engagement of the lid on the receptacle provides for concomitant engaging and retaining of that portion of the beach towel or the like disposed therebetween.

In further accordance with the teachings of the present invention, a device is disclosed for retaining a beach towel or the like in place. This device includes a receptacle for receiving sand or the like therein on a portion thereof. In this manner, a substantially downward force is applied thereon, thereby weighing the device down and retaining the device in place. The receptacle has an open portion formed therein through which the sand may pass for filling and emptying of the receptacle. A depending stem portion extends downwardly from the receptacle. At least a portion of said stem portion is inserted in sand or the like. Lastly, a lid is provided for engaging the receptacle about the open portion thereof, whereby the lid is removably retained on the receptacle. In this manner when a portion of the beach towel or the like is disposed between the lid and the receptacle, engagement of the lid on the receptacle provides for concomitant engaging and retaining of that portion of the beach towel or the like disposed therebetween.

In still further accordance with the teachings of the present invention, a device is disclosed for retaining a beach towel or the like in place. This device includes a receptacle for receiving sand or the like therein on a portion thereof. In this manner, a substantially downward force is applied thereon, thereby weighing the receptacle down and retaining the device in place. The receptacle has an open portion formed therein through which the sand may pass for filling and emptying of the receptacle. A depending stem portion extends downwardly, from the receptacle. At least a portion of the stem portion is inserted in sand or the like. A lid is provided for engaging the receptacle about the open portion thereof, whereby the lid is removably retained on the receptacle. The lid has an aperture formed therein for receiving a portion of the beach towel or the like therethrough. Lastly, a means is provided for gripping the portion of the beach towel or the like received through the aperture formed in the lid, such that the said gripped portion of the beach towel or the like is retained in place.

In various embodiments, it is preferred that the lid be a removable cap that engages the receptacle with a "snap-action" and that the lid be pivotally secured to the receptacle with, it is further preferred, a living hinge that is secured between the lid and the receptacle, whereby the lid is pivotably secured thereto.

In another embodiment, the open portion of the receptacle has a lip about it with an annular ridge extending about a portion of the lip. An opening is formed in the annular ridge. The lid has a protrusion about the outer edge such that, when a portion of the beach towel or the like is disposed in the opening in the annular ridge and the lid is engaged with the receptacle, the protrusion engages the ridge and retains the portion of the beach towel or the like. Persons skilled in the art will appreciate that the annular ridge and protrusion may be disposed either in the interior or exterior of the receptacle and lid respectively or may be reversed with the annular ridge on the lid and the protrusion on the receptacle.

Preferably, the receptacle is either substantially inverted-cone shaped or substantially rectangular in cross-section or substantially prismatic in shape.

In yet another teaching of the present invention, a beach accessory device is disclosed for receiving small articles such as keys, coins and the like. This device includes a receptacle having an open portion for receiving the articles. A portion of the receptacle is received in the sand to retain the device in place. Preferably, a stem depending portion extends downwardly from the receptacle and the stem portion has a reduced cross section for ease of insertion of the device in the sand. This stem portion may be configured to be complementary to the open portion of the receptacle for stacking a plurality of the devices. Further, the device has a lid to engage the open portion of the receptacle. Preferably, the lid is retained on the receptacle when removed from the opening.

In another embodiment, the lid of the beach accessory device has a recess therein so that when the lid is placed on the receptacle, the recess is available for stable placement of beverage containers. Alternately, the lid has a plurality of pins extending upwardly about the circumference s that when the lid is placed on the receptacle, beverage containers may be received between the pins.

These and other objects of the present invention will become apparent from a reading of the following specification taken in conjunction with the enclosed drawings.

DESCRIPTION OF PREFERRED EMBODIMENTS

Figure 1:
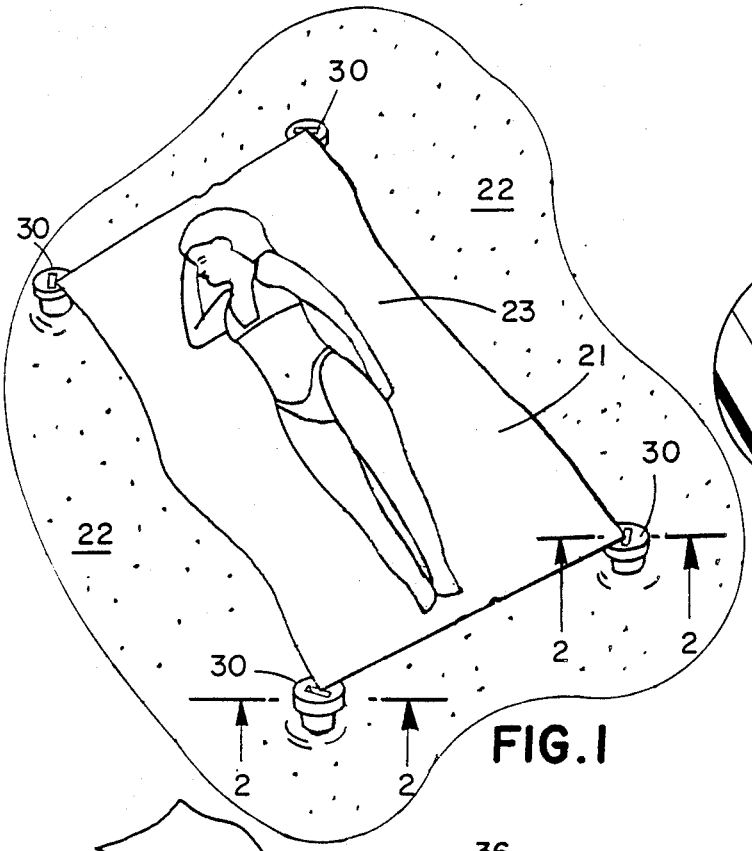
FIG. 1 is a perspective view of the device of the present invention wherein each of the four corners of a typical beach towel or the like are anchored and retained in position by a respective beach accessory device.
Figure 3:
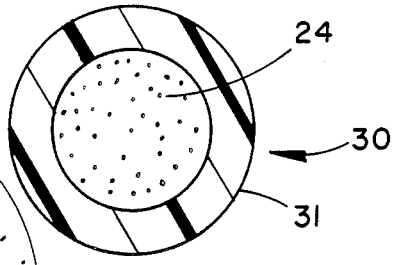
FIG. 3 is a cross-section view taken along lines 3—3 of FIG. 2.
Figure 2:
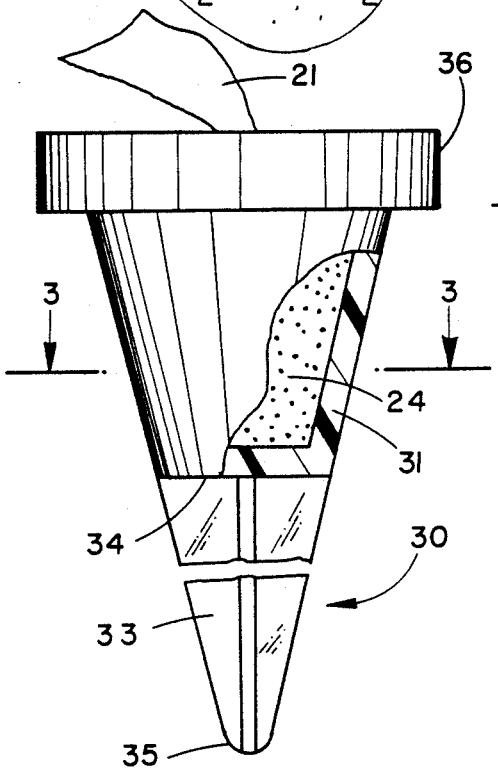
FIG. 2 is a longitudinal section view taken along lines 2—2 of FIG. 1, with a portion of the receptacle broken away to show the disposition of sand therein, so that a substantially downward force is applied thereon.

Referring now to the drawings, the device (the beach stake) 30 of the present invention is utilized to anchor, secure and retain a beach towel, blanket or the like 21 on the sand 22 of, for example, a beach. It is contemplated that, preferably, four devices 30 will be utilized, one being secured to each respective corner of the beach towel 21 being anchored and retained thereby. Secured in this fashion, the towel 21 is anchored and retained in place with a minimum of distortion thereto, even when an individual 23 is performing any of a number of various activities thereon (FIG. 1). It is to be understood however that a greater or lesser number of devices may be utilized as desired.

Figure 8:
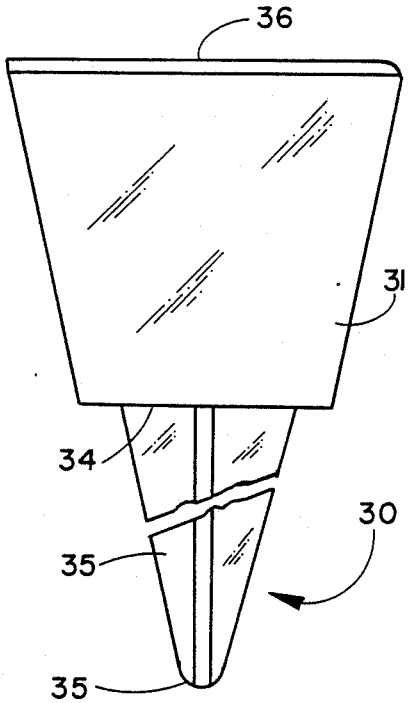
FIG. 8 is a perspective view of an alternate embodiment of the beach accessory device of the present invention in which the receptacle is substantially rectangular in cross section.
Figure 9:
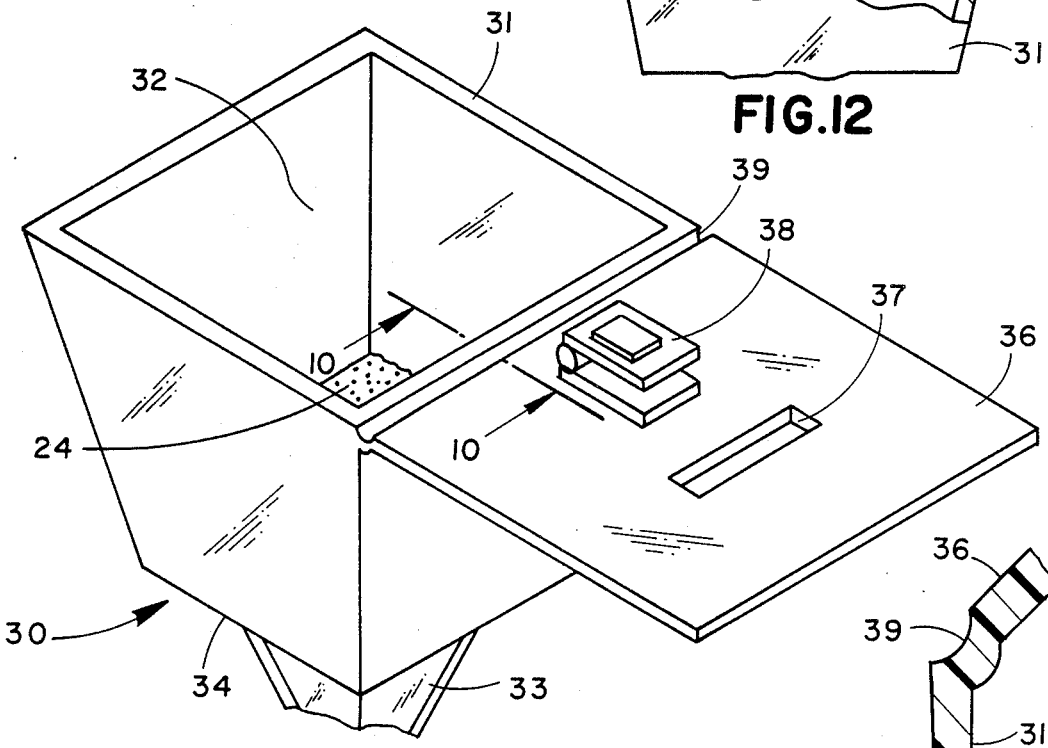
FIG. 9 is a perspective view of the device corresponding substantially to FIG. 8 but showing an integrally molded lid in its open position and further showing sand being disposed therein through the open portion.

The device 30 includes a substantially hollow receptacle 21. Preferably, the receptacle 21 is substantially inverted-cone (wine glass shape) shape. (FIGS. 1–4), alternatively, the receptacle may be substantially prismatic in shape (FIGS. 8 and 9).

The receptacle 31 has an open portion 32 formed therein. Preferably, this open portion 32 is formed in the uppermost portion of the receptacle 31. This open portion 32 provides a means through which the sand 24 may pass for partially or wholly filling and emptying of the receptacle 31.

Figure 4:
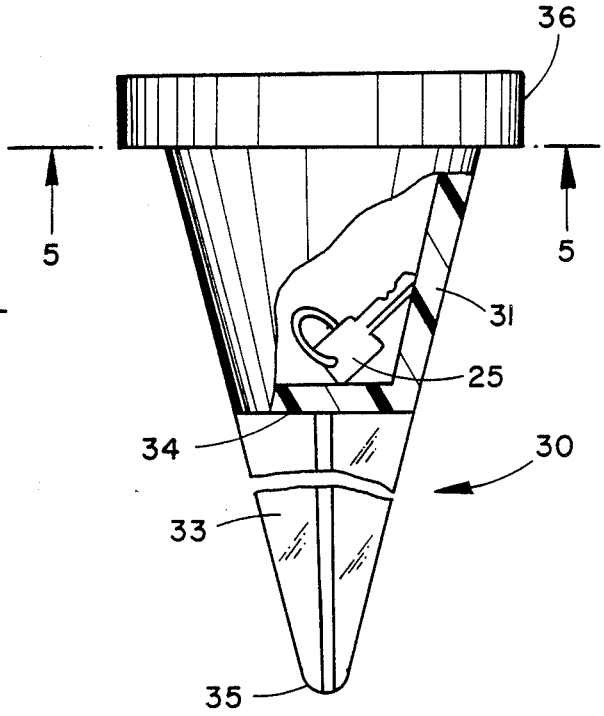
FIG. 4 corresponds to a portion of FIG. 2 illustrating how one of the four beach accessory devices may be left empty, if desired, to serve as a convenient receptacle for a watch, key or other personal items.

By the disposition of sand 24 or the like into the receptacle 31, the sand 24 therein applies a substantially downward force on that portion of the receptacle on which it is received, thereby weighing the receptacle down and retaining the receptacle in place. Keys 25, watches other personal items of or the like may also be disposed therein for hidden storage thereof while on the beach, (FIG. 4).

Extending downwardly from the receptacle 31 is a depending stem portion 33. The stem portion 33 includes a first end 34, which is intergal with the receptacle 31, and a second end 35, which is remote from the receptacle 31. Preferably, the remote end 35 has a cross-section which is reduced relative to the cross-section of the remainder of the stem portion 33. This reduction in cross-section may either occur gradually between the stem portion 33 and the remote end 35 or it may be formed by the remote end 35 being cut at an angle. This reduction in cross-section facilitates the insertion of the device in the sand 22.

It is further preferred that the remote end 35 be rounded off, so that it does not present a hazard to individuals, such as small children.

Figure 13A:
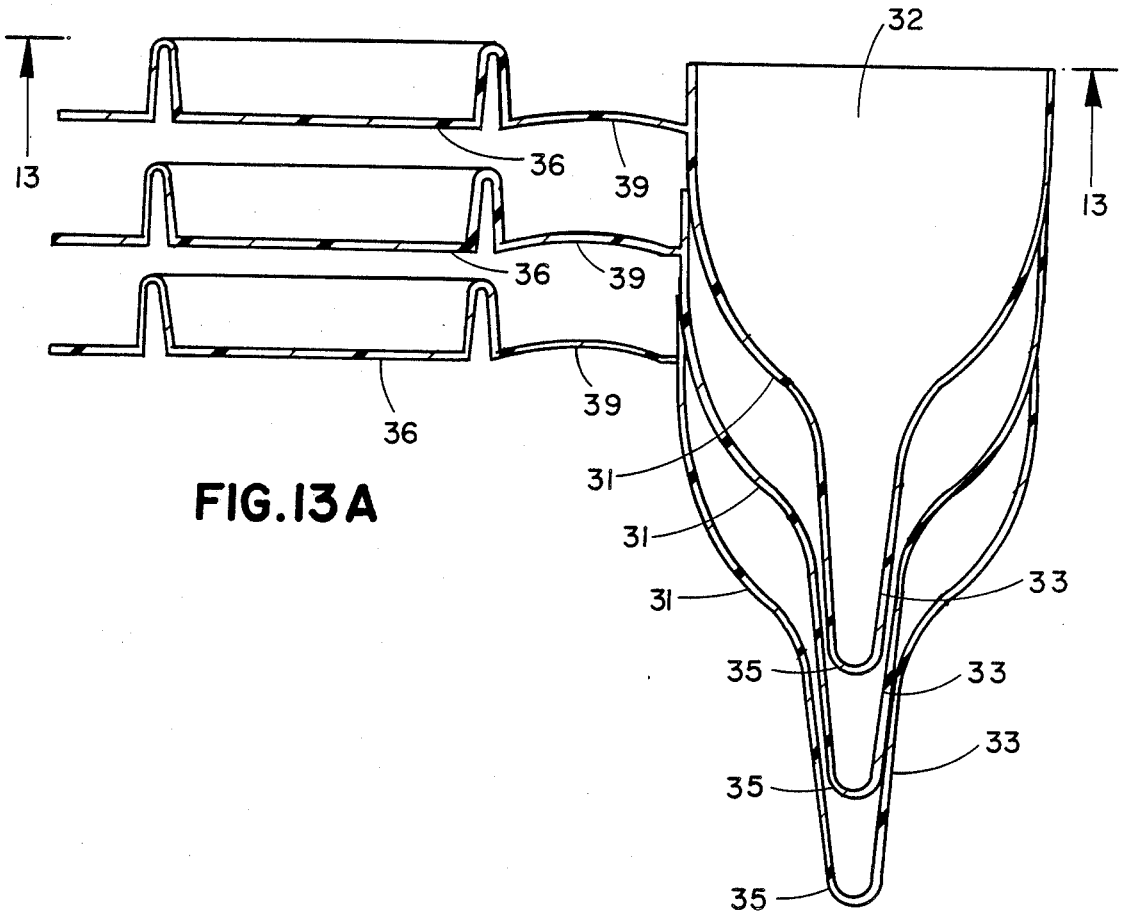
FIG. 13A is a sectional view of an alternate embodiment in which a plurality of the devices are stacked.
Figure 13B:
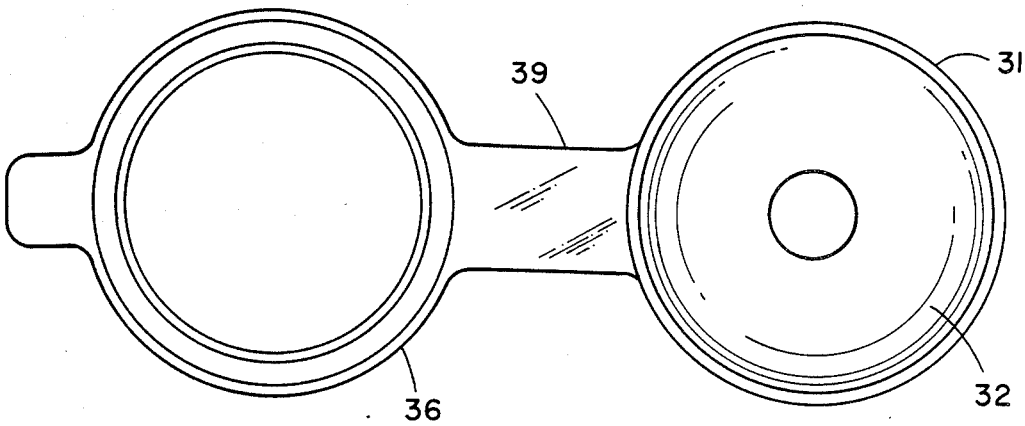
FIG. 13B is a cross-sectional view taken along lines 13—13 of FIG. 13A.

In an alternate embodiment, the remote end 35 of the stem portion 33 is configured to be complementary to the open portion 32 of the receptacle 31. This permits stacking of the devices 30 to facilitate storage and shipment (FIGS. 13A and 13B).

A lid 36 is removeably disposed extending over the open portion 32, engaging the receptacle 31 about the open portion 32. It is preferred that this securing engagement be a "snap-action" engagement, such as is well known to those skilled in the art. In this fashion, the lid 36 is removeably retained on the receptacle 31 over the open portion 32 for, inter alia, retaining therein the sand 22 and any objects such as keys 25, money, etc; disposed therein.

If desired, a portion, such as a corner, of the beach towel 21 is disposed between the lid 36 and the receptacle 31. The lid 36 may then be engaged on the receptacle 31 with the "snap-action", concomitantly engaging and retaining that portion of the beach towel 21 disposed therebetween. This provides for a simple means for gripping a portion of the beach towel 21, so that the towel is anchored and retained in place.

Figure 5:
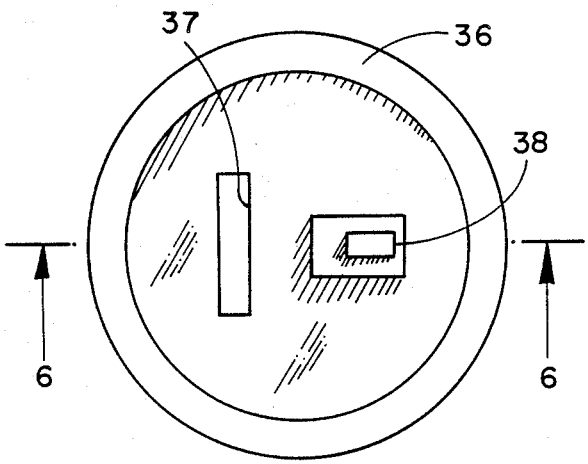
FIG. 5 is a bottom plan view of a lid for the beach accessory device.
Figure 6:
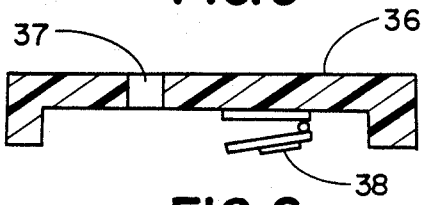
FIG. 6 is a cross-sectional view taken along lines 6—6 of FIG. 5.

Preferably, the lid 36 includes a means for gripping a portion of the beach towel 21, such that the gripped portion is retained in place, (FIG. 5 and 6). This means includes an aperture 37 formed in the lid 36 and a resilient gripping spring clip 38. Preferably, this spring clip 38 is carried by the lid 36 on the underside thereof, such that when the lid 36 is disposed and engaged on the receptacle, the spring clip 38 is positioned in the receptacle 31.

Figure 10:
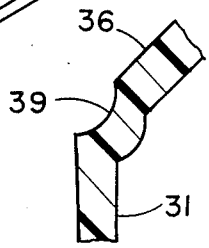
FIG. 10 is a section view taken along lines 10—10 of FIG. 9 and drawn to an enlarged scale illustrating the reduced cross-section, between the receptacle and its lid, of the "living hinge".

If desired, the lid may be integrally molded with and/or pivotably secured to the receptacle 31. This pivotal connection is, preferably, formed by use of what is commonly referred to by those skilled in the art as a "living hinge" 39 (FIG. 10). Such a "living hinge" 39 is a resiliently deformable elastic link which has one end that is integral with the lid 36 and a second opposite end that is integral with the receptacle 11. Between the first and second opposite ends, the link 39 has a portion of reduced cross-section at which the link 39 pivots. This link 39 is provided with some inherent resiliently due to its plastic "memory", which continually resiliently pivots the lid 36 towards the receptacle 31.

Figure 14A:
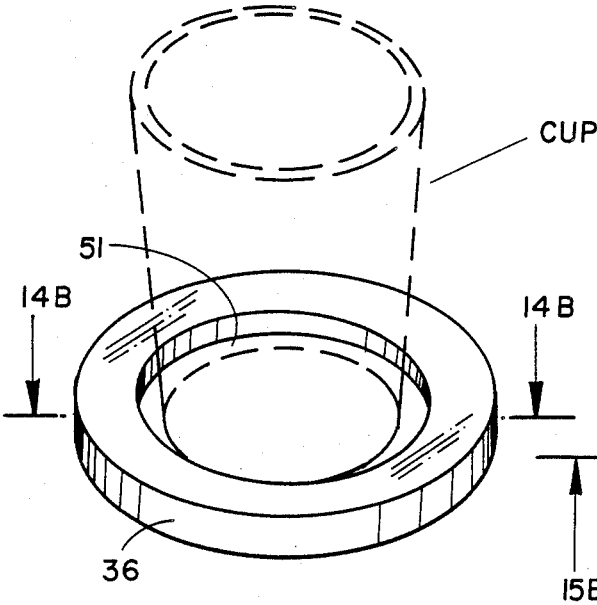
FIG. 14A is a perspective view of the lid showing a recess in the lid with beverage container therein.
Figure 15A:
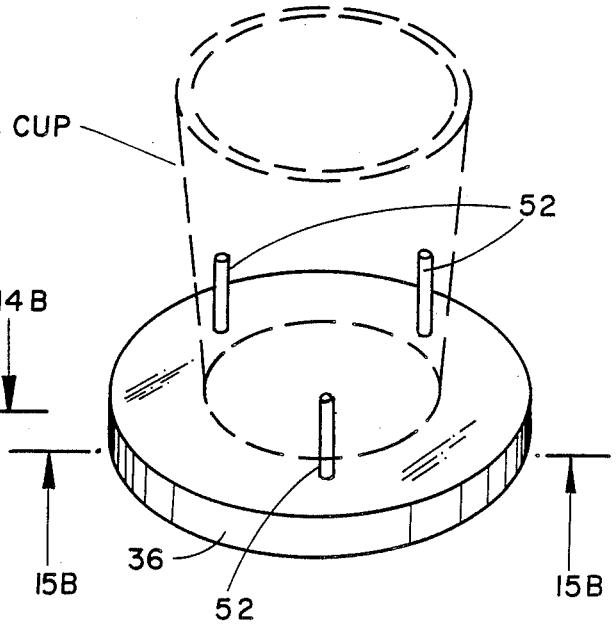
FIG. 15A is a perspective view of the lid showing pins in the lid with beverage container therein.
Figure 14B:
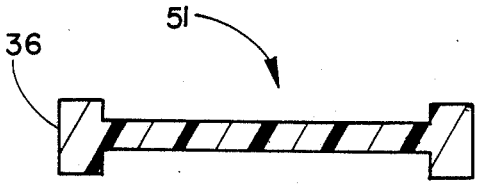
FIG. 14B is a cross-sectional view taken along lines 14–14 of FIG. 14A.
Figure 15B:
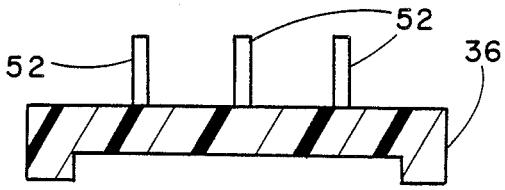
FIG. 15B is a cross-sectional view taken along lines 15—15 of FIG. 15A.

A further application of the device is as an accessory at the beach for placement of small articles and for a beverage container. In this use, the lid 36 may have a recess 51 therein so that when the lid 36 is disposed on the receptacle 31, the recess is external of the receptacle 31 and available for placement of a beverage container in the recess 51 (FIGS. 14A and 14B). Alternately, the lid 36 may have a plurality of pins 52 extending upwardly about the circumference of the lid 36, so that when the lid 36 is disposed on the receptacle 31, the pins 32 are external of the receptacle 31 and a beverage container may be received between the pins 52.

Having thus described the device 30 of the present invention, its use is now described.

Figure 7A:
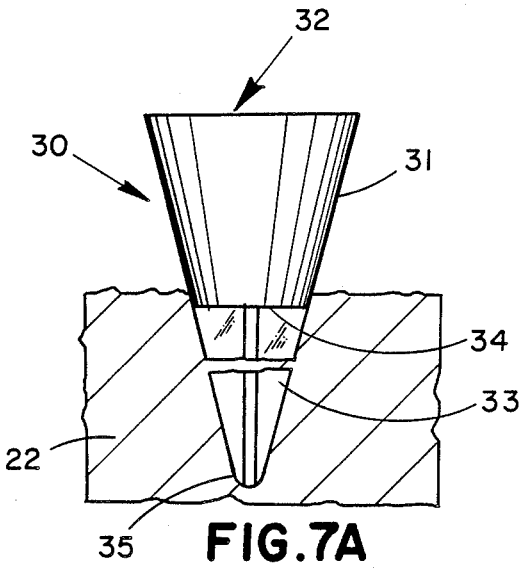
FIGS. 7A–7E are schematic sequence views illustrating one method of how the device of the present invention may be used.

First, the second remote end 35 of the stem portion 33 is inserted in the sand 22, piercing the sand. Continued downward pressure on the device 30 results in at least a portion of the device 30, and in particular at least a portion of the stem portion 33, being inserted into the sand (FIG. 7A). Preferably, at least a portion of the receptacle 31 is also received in the sand 22. It is most preferred for substantially all of the device 30, including the stem portion 33 and the receptacle 31 are inserted into the sand 22.

Insertion of the device 30 into the sand 22 as described above, permits the sand 22 to annularly contact the device 30 about the periphery thereof. Such contact results in the sand 22 applying a substantially sideward force on said portion of the device inserted into the sand. This force provides a means by which substantially sideward forces exerted on the stake 30 by the engagement of activities on the towel are counteracted.

Figure 7B:
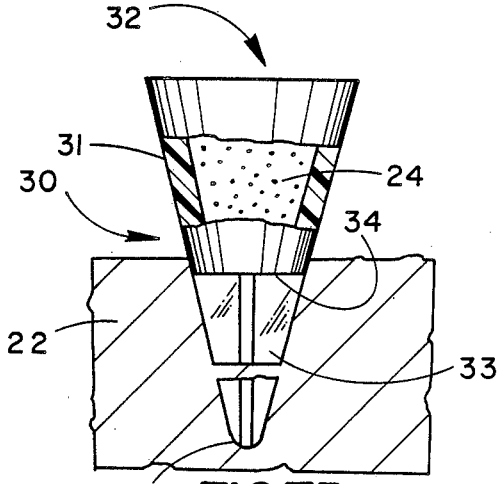

Second, sand 24 is inserted into the substantially hollow interior of the receptacle 31 through the open portion 32 thereof (FIG. 7B). This sand 24 is received in the receptacle 31 filling it. This permits the sand 24 to interiorly contact the receptacle 31 of the device 30 applying a substantially downward force thereon. This force provides a means by which substantially upward forces exerted on the device 30 by the engagement of activities on the towel are counteracted.

Lastly, the towel 21 is secured to the device 30.

Figure 7C:
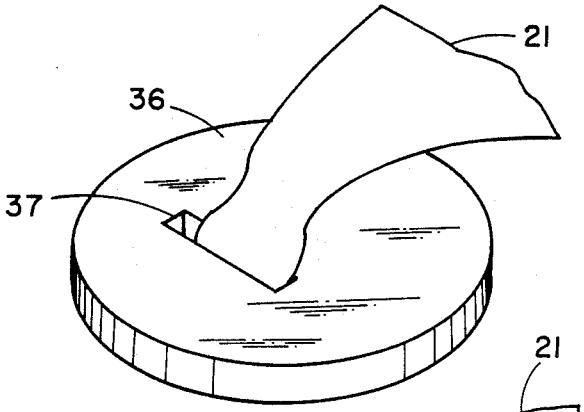
Figure 7D:
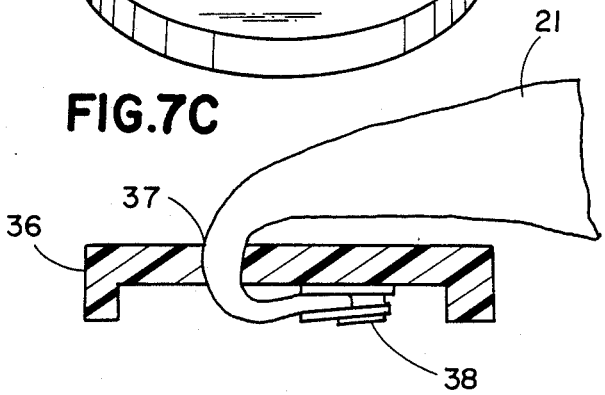
Figure 7E:
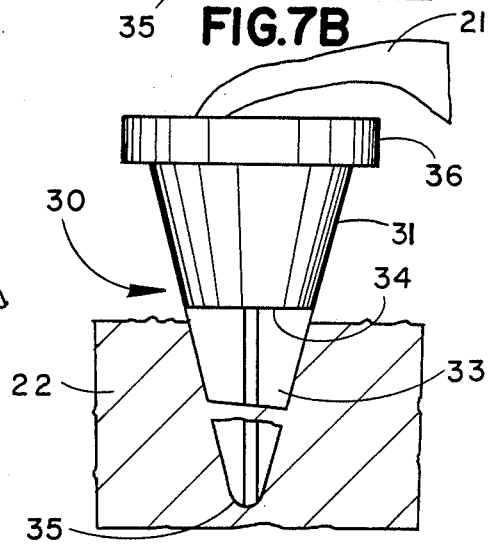
Figure 12:
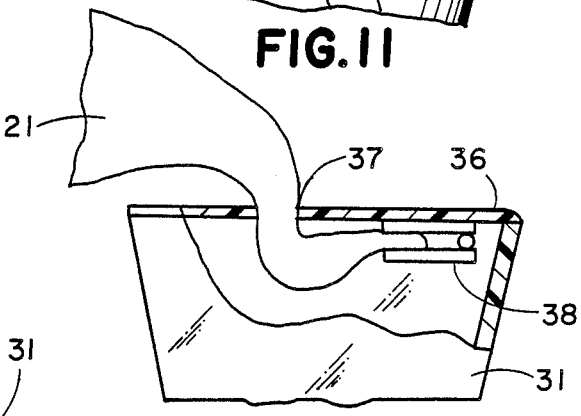
FIG. 12 is a schematic view of the embodiment of FIGS. 8 10 showing the integrally molded lid having an aperture therein and a gripping portion.

In a preferred embodiment, a portion (preferably a corner portion) of the towel 21 is looped through the aperture 37 formed in the lid 36 (FIG. 7C) this portion of the towel 21, is then "looped" substantially backwardly gripped by the said clip 38, where it is received and gripped by the said clip 38 (FIG. 7D). If desired, the portion of the towel 21 may, alternatively, be further moved substantially forwardly toward the spring clip 38, where it is received and gripped thereby (FIG. 12) The lid 36 is then disposed over the open portion 32 and secured thereto, retaining the sand 24 therein and securing the towel 21 to the device 30. (FIG. 7E).

Figure 11:
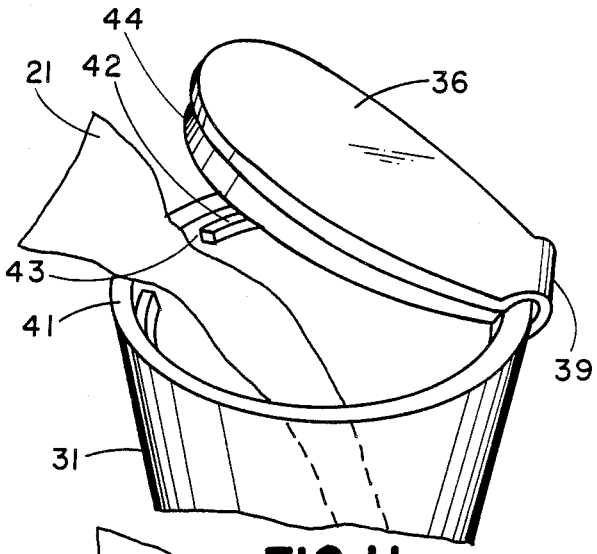
FIG. 11 is a perspective view showing another method of lid closure.

In another embodiment, a portion (preferably a corner portion) of the towel 21 disposed between the lid 36 and the receptacle 31. The lid is then engaged by a "snap action" to the receptacle, concomitantly engaging and retaining that portion of the beach towel disposed therebetween, (FIG. 11). The "snap action" may be effected by a lip 41 about the open portion 32 of the receptacle 31 having an annular ridge 42 thereon. The ridge 42 encompasses a portion of the lip 41 such that there is an opening 43 in the annular ridge 42. The portion of the towel 21 is disposed in this opening 43. The lid 36 has a protrusion 44 about its outer edge such that engaging the lid 36 with the receptacle 31, causes the protrusion 44 to engage the annular ridge 42 in a "snap action" thereby retaining the portion of the towel 21. Other "snap action" designs may be used as are known to persons skilled in the art.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a towel or the like intended for use on the beach, wherein wind currents normally whip the towel around and prevent the towel from lying smoothly on the beach, the beach towel having a plurality of corners, a plurality of devices associated with the corners of the towel for retaining the towel on the beach, each of the devices comprising a hollow main body portion having an open top, so that sand is poured through the open top into the main body portion, thereby substantially increasing the weight of the device, the device further comprising a stem portion formed integrally with the main body portion such that an intersection is formed therebetween, the stem portion depending therefrom, and adapted to be pressed into the beach, such that the device is buried in the beach to a depth substantially to the intersection between the main body portion and the stem portion of the device, a lid removably engaging the open top of the main body portion of the device, and means for retaining the corner of the beach towel or the like by the device.

2. The combination of claim 1, wherein the lid is a removable cap that engages the main body with a "snap-action".

3. The combination of claim 1, wherein the lid has a recess therein such that when the lid is disposed on the main body, the recess is external of the main body and available for placement of beverage containers or the like therein.

4. The combination of claim 1, wherein the lid is pivotably secured to the main body.

5. The combination of claim 4, further including a living hinge secured between the lid and the main body, whereby the lid is pivotably secured to the main body.

6. The combination of claim 1, wherein the means for retaining the corner of the towel by the device comprises the main body having a lip about the open top, the lip having an annular ridge thereon, the ridge encompassing a portion of the lip such that there is an opening in the annular ridge, the lid having an outer edge with a protrusion thereabout such that when a portion of the beach towel or the like is disposed in the opening in the annular ridge on the main body, engagement of the lid on the main body engages the protrusion with the annular ridge to secure the lid to the main body thereby retaining that portion of the towel disposed therebetween.

7. The combination of claim 1, wherein the main body is substantially inverted-cone shaped.

8. The combination of claim 1, wherein the m ain body is substantially rectangular in cross-section.

9. The combination of claim 1, wherein the main body is substantially prismatic in shape.

10. The combination of claim 1, wherein the depending stem portion includes an end remote from the main body, said remote end having a reduced cross-section, thereby facilitating insertion of the device in the sand.

11. The combination of claim 10, wherein the remote end is rounded off.

12. The combination of claim 1, wherein the remote end is complementary of the main body such that a plurality of devices may be stacked for ease of shipment and storage.

13. The combination of claim 1, wherein the stem portion is substantially elongated and relatively narrow.

14. The combination of claim 1, wherein the stem portion is tapered.

15.

in combination with a towel or the like intended for use on the beach, wherein wind currents normally whip the towel around and prevent the towel from lying smoothly on the beach, the beach towel having a plurality of corners, a plurality of devices associated with the corners of the towel for retaining the towel on the beach, each of the devices comprising a hollow main body portion having an open top, so that sand is poured through the open top into the main body portion, thereby substantially increasing the weight of the device, the device further comprising a stem portion formed integrally with the main body portion such that an intersection is formed therebetween, the stem portion depending therefrom, and adapted to be pressed into the beach, such that the device is buried in the beach to a depth substantially to the intersection between the main body portion and the stem portion of the device, a lid removably engaging the open top of the main body portion of the device, means for retaining the corner of the beach towel or the like by the device, wherein the lid is a removable cap that engages the main body with a "snap-action"; and further including a living hinge secured between the lid and the main body, whereby the lid is pivotably secured to the main body.

16.

in combination with a towel or the like intended for use on the beach, wherein wind currents normally whip the towel around and prevent the towel from lying smoothly on the beach, the beach towel having a plurality of corners, a plurality of devices associated with the corners of the towel for retaining the towel on the beach, each of the devices comprising a hollow main body portion having an open top, so that sand is poured through the open top into the main body portion, thereby substantially increasing the weight of the device, the device further comprising a stem portion formed integrally with the main body portion such that an intersection is formed therebetween, the stem portion depending therefrom, and adapted to be pressed into the beach, such that the device is buried in the beach to a depth substantially to the intersection between the main body portion and the stem portion of the device, a lid removably engaging the open top of the main body portion of the device, the lid having an aperture formed therein for receiving a portion of the beach towel or the like therethrough; and means for gripping the portion of the beach towel or the like received through the aperture formed in the lid, such that the gripped portion of the beach towel or the like is retained in place.

17. The combination of claim 16, wherein the means for gripping includes a resilient gripping hinge formed about the aperture.

18. The combination of claim 16, wherein the means for gripping includes a resilient spring clip.

19. The combination of claim 18, wherein the spring clip is carried by the lid, such that when the lid is disposed on the main body, the spring is positioned in the main body.

20. The combination of claim 16, wherein the lid is a removable cap that engages the main body with a "snap-action".

21. The combination of claim 16, wherein the lid is pivotably secured to the main body.

22. The combination of claim 21, further including a living hinge secured between the lid and the main body, whereby the lid is pivotably secured to the main body.

23. The combination of claim 16, wherein the main body is substantially inverted-cone shaped.

24. The combination of claim 16, wherein the main body is substantially rectangular in cross-section.

25. The combination of claim 16, wherein the main body is substantially prismatic in shape.

26. The combination of claim 16, wherein the depending stem portion includes an end remote from the main body, said remote end having a reduced cross-section, thereby facilitating insertion of the device in the sand.

27. The combination of claim 26, wherein the remote end is rounded off.

28.

in combination with a towel or the like intended for use on the beach, wherein wind currents normally whip the towel around and prevent the towel from lying smoothly on the beach, the beach towel having a plurality of corners, a plurality of devices associated with the corners of a towel for retaining the towel on the beach, each of the devices comprising a hollow main body portion having an open top, so that sand is poured through the open top into the main body portion, thereby substantially increasing the weight of the device, the device further comprising a stem portion formed integrally with the main body portion such that an intersection is formed therebetween, the stem portion depending therefrom, and adapted to be pressed into the beach, such that the device is buried in the beach to a depth substantially to the intersection between the main body portion and the stem portion of the device, a lid removably engaging the open top of the main body portion of the device, the lid having an aperture formed therein for receiving a portion of the beach towel or the like therethrough; means for gripping the portion of the beach towel or the like received through the aperture formed in the lid, such that the said gripped portion of the beach towel or the like is retained in place; wherein the means for gripping includes a resilient spring clip; wherein the spring clip is carried by the lid, such that when the lid is disposed on the main body, the spring is positioned in the main body; and further including a living hinge secured between the lid and the main body, whereby the lid is pivotably secured to the main body.

29. In combination with a towel or the like intended for use on the beach, the beach towel having a plurality of corners, a plurality of devices associated with the corners of the towel for retaining the towel on the beach, each of the devices comprising a hollow main body having an open top portion so that the body may be at least partially filled with sand, thereby adding weight to the device, a substantially elongated, stem portion adapted to be pushed into the beach to retain the device on the beach, a lid pivotably secured to the main body portion of he device by an integrally-formed living hinge, so that the lid may cover the open top portions of the body with a "snap fit", and so that a corner of a beach towel may be lodged between the lid and the body at the open top portion thereof, as the lid is snapped on to the body, thereby retaining the towel, and wherein a plurality of devices may be nested with respect to each other for improved compactness for storage and shipment.

30. The combination of claim 29, wherein the stem portion is hollow and the lid, when open, extends outwardly from the body such that a plurality of the devices may be nested, the stem and body of each device fitting within, and being complementary with, the respective stem and body of the adjacent device and the lids being nested externally from the bodies such that storage and shipment of the devices is facilitated.

* * * * *